United States Patent [19]

Krasnoff et al.

[11] 4,142,447

[45] Mar. 6, 1979

[54] HYDRAULIC ACTUATOR

[75] Inventors: Eugene L. Krasnoff, Princeton; Herman Lindeboom, Pennington, both of N.J.

[73] Assignee: Ingersoll-Rand Company, Woodcliff Lake, N.J.

[21] Appl. No.: 890,382

[22] Filed: Mar. 27, 1978

Related U.S. Application Data

[63] Continuation of Ser. No. 699,493, Jun. 24, 1976, abandoned, which is a continuation-in-part of Ser. No. 533,969, Dec. 18, 1974, abandoned.

[51] Int. Cl.[2] ..... F01L 25/02

[52] U.S. Cl. ..... 91/280; 91/321; 91/327

[58] Field of Search ..... 91/235, 280, 281, 282, 91/285, 317, 319, 321, 327, 417, 460

[56] References Cited

U.S. PATENT DOCUMENTS

| | | | |
|---|---|---|---|
| 1,350,342 | 8/1920 | Smith | 91/281 |
| 2,867,191 | 1/1959 | Herrmann | 91/280 |
| 2,921,559 | 1/1960 | Herrmann | 91/280 |
| 2,932,175 | 4/1960 | May | 91/280 |
| 2,937,621 | 5/1960 | Herrmann | 91/280 |
| 3,774,502 | 11/1973 | Arndt | 91/321 |

FOREIGN PATENT DOCUMENTS

| | | | |
|---|---|---|---|
| 291968 | 10/1929 | Fed. Rep. of Germany | 91/285 |

*Primary Examiner*—Martin P. Schwadron
*Assistant Examiner*—Abraham Hershkovitz
*Attorney, Agent, or Firm*—Frank S. Troidl

[57] ABSTRACT

A hydraulically operated reciprocating piston and a differential force operated valve are both in continuous fluid contact with a pressurized cushion chamber as well as the piston chamber pressure. The valve position is a function of the cushion chamber pressure. The cushion chamber pressure is a function of the axial position of the piston. The values of these functions are such that the piston is reciprocated when the machine is operated. The valve may, for example, be a sleeve coaxial with the piston or a valve transversely spaced from the piston.

4 Claims, 9 Drawing Figures

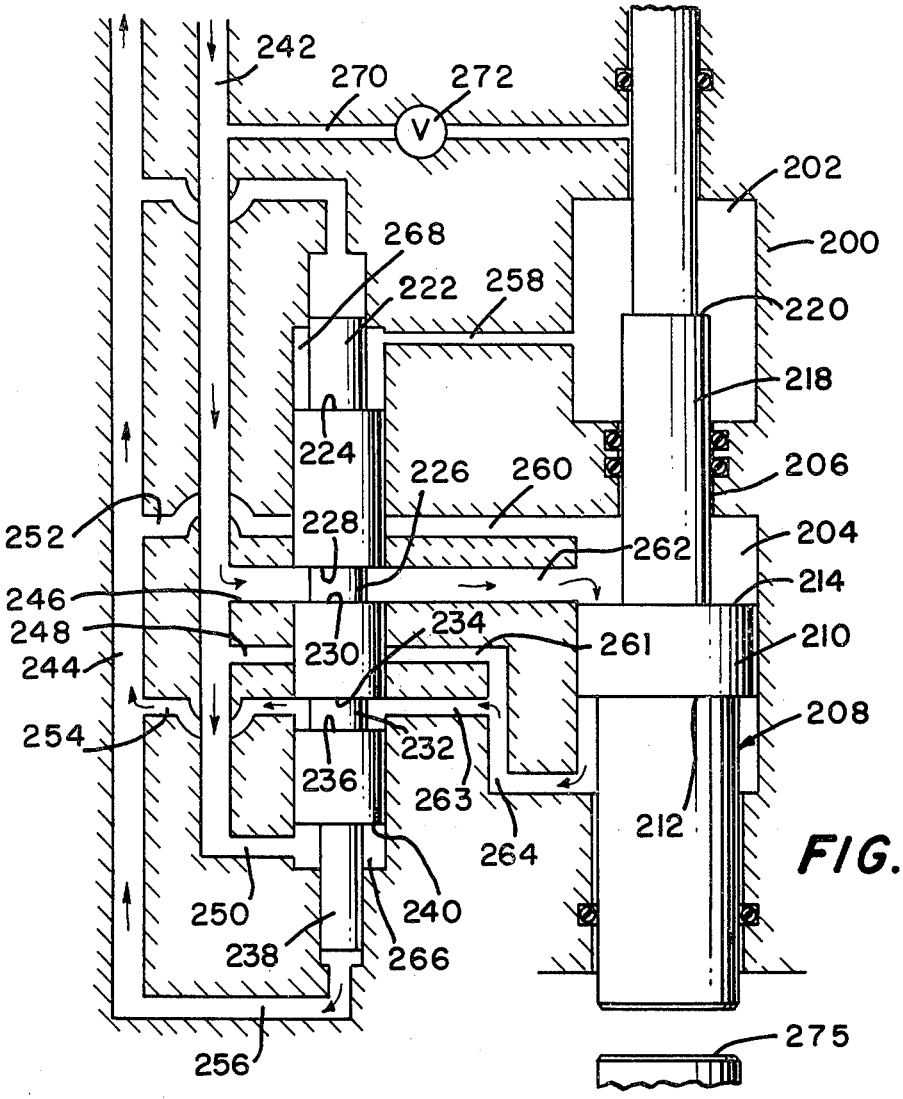
FIG. 7
FIG. 8
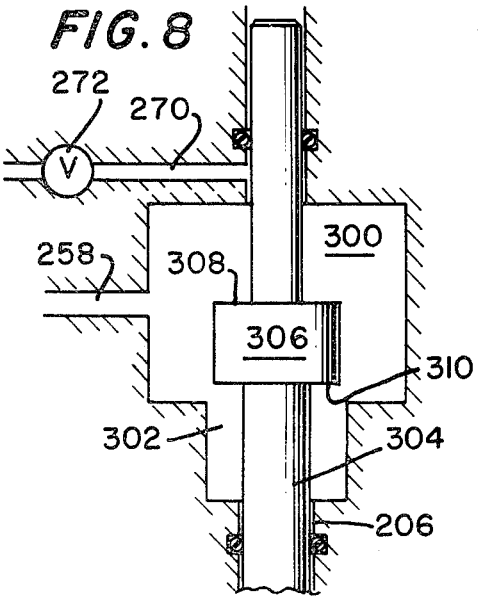
FIG. 9
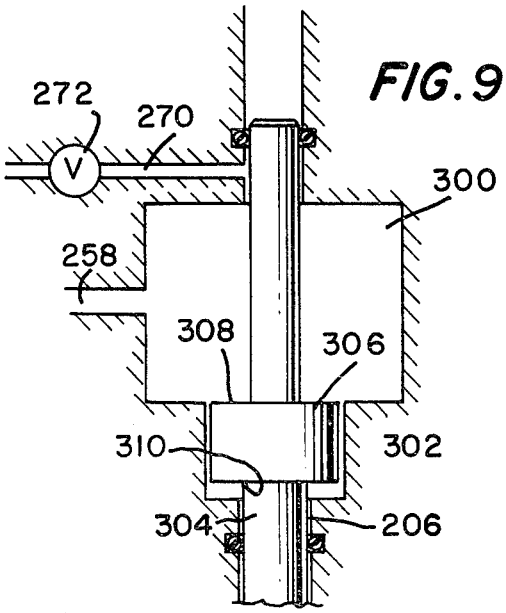

HYDRAULIC ACTUATOR

This is a continuation of application Ser. No. 699,493 filed June 24, 1976, now abandoned which is continuation in part of application Ser. No. 533,969, filed Dec. 18, 1974, now abandoned.

This invention relates to hydraulic actuators. More particularly, this invention is a new and novel differential force controlled hydraulic actuator including a pressure controlled valve for reciprocating a piston.

Hydraulic actuators usually have a reciprocating piston controlled by hydraulic fluid flow into or out of the piston chamber through axially separated sets of ports. Hydraulic actuators are usually controlled by some sort of "position" control; that is, the application of hydraulic pressure against a piston to reciprocate the piston is dependent upon the position of the piston, itself, that is, a set of ports is open or closed, depending on the position of the piston, or a valve opens or closes the sets of ports to control the flow of hydraulic fluid to and from the piston chamber.

With position type hydraulic actuators, particularly high impacting force devices, a position change of the load or anvil will cause excessive variation in reaction forces. With hand-held tools, these reaction forces can be bothersome to the operator.

Our new hydraulic actuator includes a purely pressure controlled valve for controlling the flow of liquid into and out of one or more working cylinders of an actuator. The driving pressure force is nearly constant and this produces a low reaction force on the case. With our pressure controlled device, the case reaction remains relatively insensitive to position changes of the load or anvil.

Hydraulic impact tool actuators built for the high flow energy required in demolition work, tamping, and rock drilling are plagued by severe pulsation problems. These pulsations lead to early failure of actuator parts and supply or discharge line fittings. With currently used actuators, gas accumulators or the equivalent are employed with the resulting operating costs associated with maintaining required gas pressures.

In our new hydraulic actuator, pressure pulsations are minimized without the use of gas accumulators or excessively large volumes of hydraulic fluid.

Briefly described, out new hydraulic actuator comprises a housing with a pressurized cushion chamber, and a piston chamber interconnected by a bore of less diameter than either the cushion chamber or the piston chamber. During the entire cycle, the piston extends from the piston chamber through the interconnecting chamber and into the cushion chamber. The structure of the piston is such that the piston chamber and cushion chamber are substantially pressure isolated from one another during the entire cycle. The piston is provided with a cushion pressure surface which is continuously subjected to the cushion chamber pressure. The axial position of the piston cushion pressure surface controls the cushion pressure. A valve is also continuously subjected to the cushion chamber pressure and includes surfaces subjected to the operating pressure and exhaust pressure. As the piston moves downwardly, the cushion chamber pressure and therefore the force exerted against the valve is decreased. When a predetermined differential force exists, the valve is shifted to its second position to permit the application of hydraulic fluid against the piston to reverse the direction of movement of the piston. As the piston thereafter moves upwardly, the cusion chamber pressure continuously increases. When the differential force reaches a predetermined amount, the valve is then shifted to its first position. The cycle is continuously repeated as long as the hydraulic actuator is being operated.

The valve may, if desired, comprise a slidable sleeve coaxial with the piston. The sleeve has an inside diameter substantially equal to the diameter of the piston shoulders.

In the alternative, the valve means may include a valve member transversely spaced from the piston with fluid pressure lines extending from the cushion chamber to the valve member.

The invention, as well as its many advantages, may be further understood by reference to the following detailed description and drawings in which:

FIG. 7 is a view similar to FIG. 8 showing the valve and piston in their second positions;

FIG. 8 is a schematic representation of a cushion chamber embodiment including structure for absorbing kinetic energy of the piston; and FIG. 9 is a view similar to FIG. 8 showing the pistons in a different position.

In the various figures, like parts are referred to by like numbers.

Figure 1:
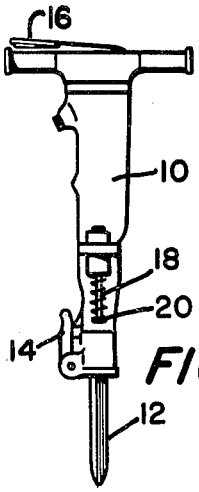
FIG. 1 is an elevational view of a paving breaker in which our new hydraulic actuator may be used.
Figure 4:
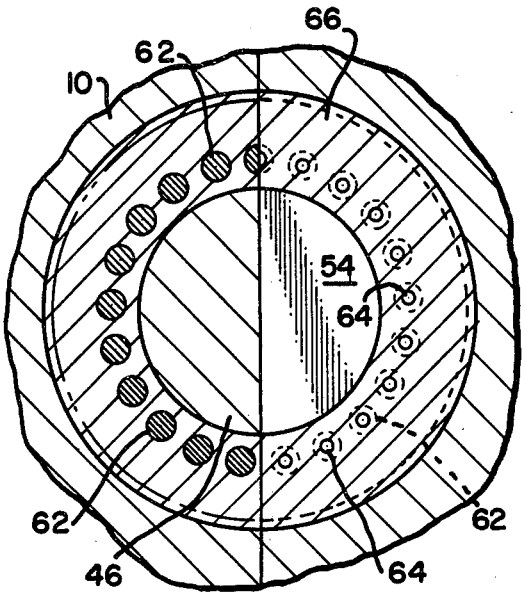
FIG. 4 is a view generally drawn along lines 4—4 of FIG. 2.

Referring to the drawings, and more particularly, to FIG. 1, there is shown a paving breaker including a housing 10 to which is attached means for breaking pavements such as breaker 12. The breaker 12 is attached to the bottom of the housing 10 by means of a pivoted lever 14. To operate the paving breaker, the operator presses handle 16 downwardly. A coaxial spring 18 is mounted about the bolt 20 and helps absorb shock.

It is to be clearly understood that although we have illustrated our new hydraulic actuator in a paving breaker, the hydraulic actuator can be used for any other use for which hydraulic actuators are used. Our invention is in a pressure-operated hydraulic actuator and not restricted to use in a paving breaker.

Figure 2:
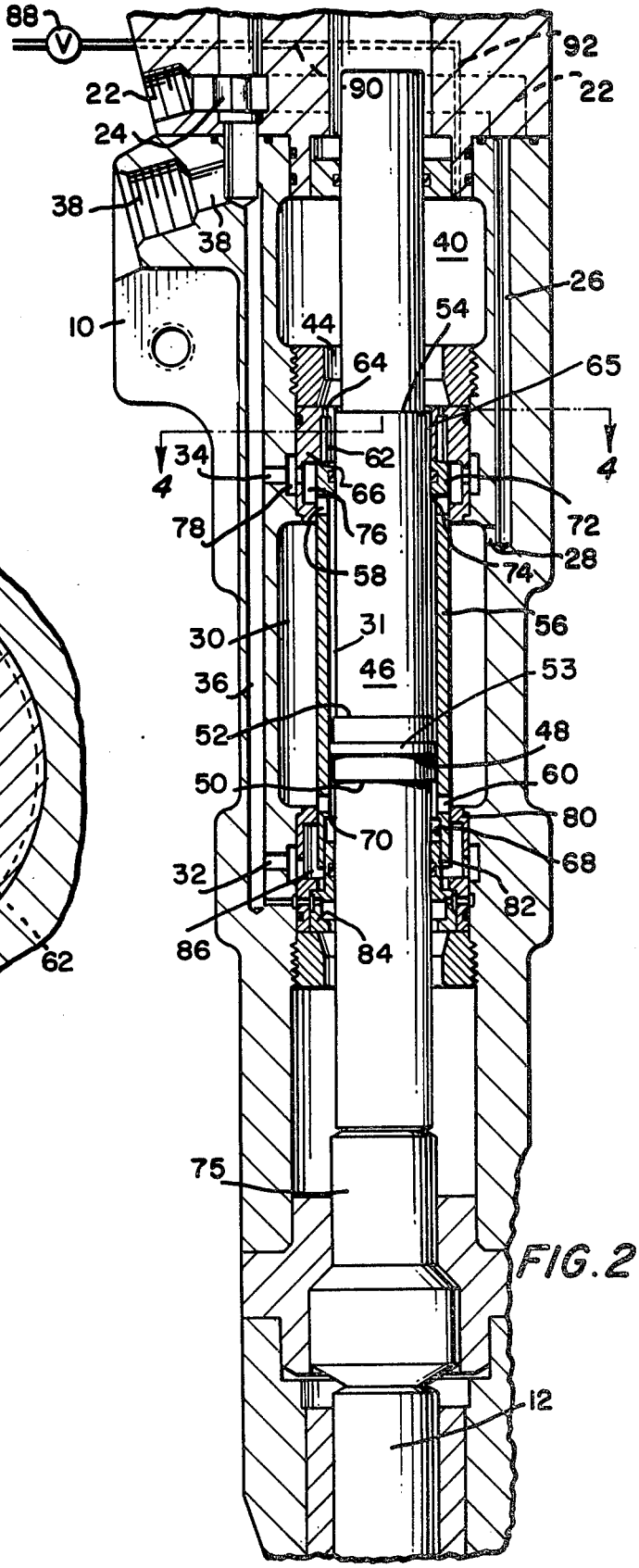
FIG. 2 is an enlarged sectional view of the novel components of our new hydraulic actuator showing a sleeve valve in one position.

Referring more specifically to FIG. 2, hydraulic fluid is fed to the housing 10 by means of fluid lines, such as line 22 controlled by valve 24. The fluid is fed from line 22 to a longitudinally extending pressure line 26, and transversely extending line 28, through chamber 30, through ports 60 in sleeve 56, and into piston chamber 31. Hydraulic fluid is exhausted from the piston chamber 31 through ports 58 in sleeve 56, chamber 76, chamber 78, and exhaust fluid line 34. The exhaust fluid line 34 runs into the longitudinally extending fluid line 36 and from the housing by means of fluid line 38 near the top of the housing.

Within the housing there is provided a pressurized cushion including a pressurized cushion chamber 40 and a bore 44 extending downwardly from the cushion chamber. The reciprocating piston 46 has a longitudinal portion 48 of greater diameter than the remainder of the piston, thus providing a first shoulder 50 and second shoulder 52. Annular seal 53 on longitudinal portion 48 provides a close fit of the portion 48 with the wall of piston chamber 31. A cushion pressure shoulder 54 on the piston 46 is continuously subjected to the pressure in the cushion chamber 40 and bore 44.

The pressurized cushion is always substantially pressure isolated from the piston chamber 31 during the entire piston reciprocating cycle. An interconnecting bore 65 in pin retainer 66 has a smaller diameter than the diameter of bore 44 of the cushion and a smaller diameter than the diameter of piston chamber 31. Piston 46 extends through piston chamber 31, through bore 65 and into the pressurized cushion including bore 44 and cushion chamber 40. That part of piston 46 which moves within interconnecting bore 65 has a diameter substantially the same as the diameter of the interconnecting bore to keep the cushion substantially pressure isolated from the piston chamber during the entire cycle.

In the embodiment shown in FIG. 2, the pressure operated valve includes the slidable sleeve 56 coaxial with the piston 46. The inside diameter of the sleeve is substantially equal to the diameter of the longitudinal portion 48 of piston 46. A first set of circumferentially evenly spaced ports 58 and a second set of circumferentially evenly spaced ports 60 longitudinally spaced from the first set of ports are provided in the slidable sleeve 56.

A plurality of pins 62 are held against the end of the sleeve facing the cushion chamber 40. The pins 62 are circumferentially equally spaced on the end of the sleeve 56. The top part of each pin 62 is continuously subjected to the cushion pressure through ports 64 formed in the pin retainer 66. A port is provided for each pin. In the particular embodiment shown there are twenty-one ports 64 and twenty-one pins 62. Of course, any particular number of pins and ports may be used if desired.

The sleeve 56 has at its lower end a bore 68 of greater inside diameter than the diameter of the rest of the sleeve thus providing a downwardly extending annular shoulder 70. (See FIGS. 2 and 3). The extreme upper portion 72 of the sleeve 56 has a bore substantially the same size as the piston 46 thus providing a downwardly extending annular shoulder 74.

In the operation of the embodiment shown in FIGS. 1 through 5, FIG. 2 shows the relative positions of the sleeve 56 and the piston 46 with the piston 46 in its lowermost position striking the anvil 75, which in turn strikes the breaker 12. Note that the ports 60 are not closed by the piston portion 48. The cushion pressure has just reached a low enough pressure so that the sleeve 56 has been shifted to its uppermost position so that the ports 60 are exposed to chamber 30 and the ports 58 are exposed to the exhaust lines.

Hydraulic fluid is fed into fluid line 22, through open valve 24, through longitudinally extending line 26, transverse line 28, chamber 30, ports 60 and into piston chamber 31. This fluid pressure is exerted upwardly against the shoulder 50 on longitudinal portion 48 of the piston 46 and also upwardly against the annular shoulder 70 on sleeve 56. The force on shoulder 50 moves the piston 46 upwardly against the force exerted against annular shoulder 54.

Initially, the operating force on annular shoulder 70 plus the exhaust force on annular shoulder 74 is greater than the force operating against the pins 62 through ports 64, thus tending to keep the valve sleeve 56 in the upper position shown in FIG. 2.

As the piston moves upwardly, hydraulic fluid is exhausted from piston chamber 31 through ports 58, chamber 76 in pin retainer 66, chamber 78 in the housing 10, ports 34, longitudinal line 36, and line 38. Also, as the piston 46 moves upwardly, the hydraulic fluid in the cushion is compressed by shoulder 54, thus increasing the pressure in the cushion chamber 40. This increased pressure is transmitted through bore 44 and ports 64 against the pins 62. Before the piston 46 reaches its uppermost position, the force against pins 62 exceeds the opposing operating force against annular shoulder 70 in sleeve 56 plus the opposing exhaust force against annular shoulder 74 in the sleeve. The sleeve 56 is then snapped downwardly to the position shown in FIG. 3. Ports 58 are continuously open to exhaust during the entire upward movement of the piston and never closed by the piston.

Figure 3:
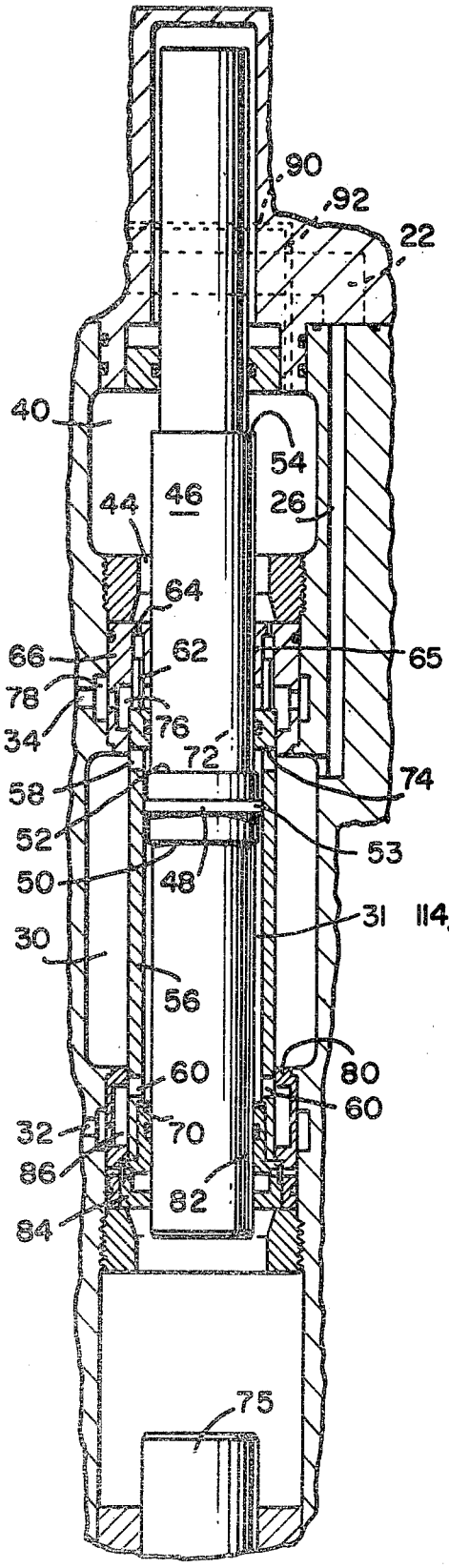
FIG. 3 is an enlarged sectional view showing the sleeve valve in the second position.
Figure 5:
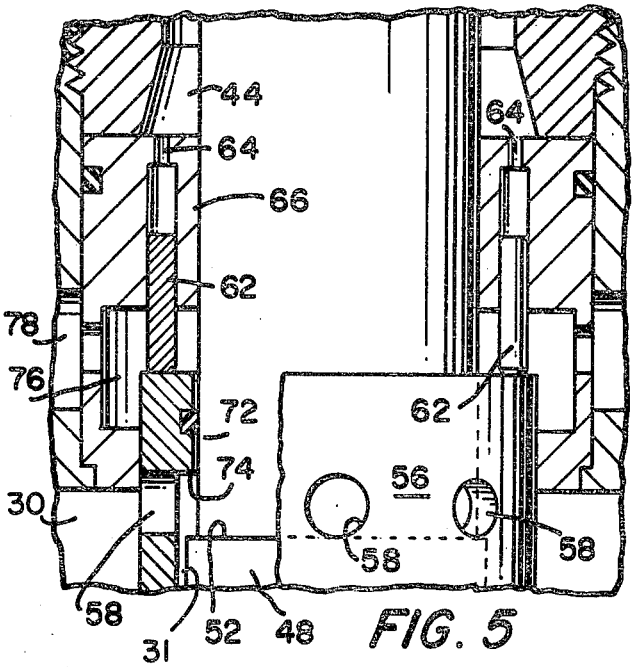
FIG. 5 is an enlarged view, partly in section, showing certain details of the sleeve valve and the pin retainer.

As shown in FIG. 3, the sleeve has been moved downwardly to expose piston chamber 31 to chamber 30 through ports 58. Ports 60 are exposed to the exhaust lines. The annular shoulder 70 in sleeve 56 abutts against the flange 82 in the lower bearing 84.

Fluid from the chamber 30 is then fed through ports 58 in sleeve 56 against shoulder 52 on the longitudinal portion 48 of piston 46. Also, the pressure from chamber 30 works against shoulder 74 on the upper portion 72 of sleeve 56. Fluid in the sleeve 56 is exhausted from the sleeve through ports 60, bore 86 in lower bearing sleeve 80, transverse fluid line 32, and longitudinal fluid line 36 (see FIG. 2 and FIG. 3). Exahaust pressure is also exerted against lower shoulder 70 in sleeve 56.

As piston 46 moves downwardly, the hydraulic fluid in the cushion expands thereby decreasing in pressure. As the force operating against the pins 62 decreases, it will reach a predetermined force where said force is less than the operating force against annular shoulder 72 plus the exhaust force against annular shoulder 70. This force is reached just before the piston 46 strikes the anvil 75. Sleeve 56 is then shifted back to the position shown in FIG. 2; and the cycle continuously repeated.

During the operation of this invention, either ports 58 or ports 60 are exposed to chamber 30. At no time are both ports 58 and ports 60 shut off from chamber 30. Thus, fluid from chamber 30 is never dead-ended and pressure pulsations are minimized. Also, during the entire cycle of the piston neither ports 58 or ports 60 are ever closed by the piston.

If desired, the predetermined pressure range in cushion chamber 40 may be made adjustable for flexibility of the cycle. For this purpose, a valve 88 is provided in line 90 (see FIG. 2). This valve controls the flow of liquid into cushion chamber 40 through line 90 and line 92.

Figure 6:
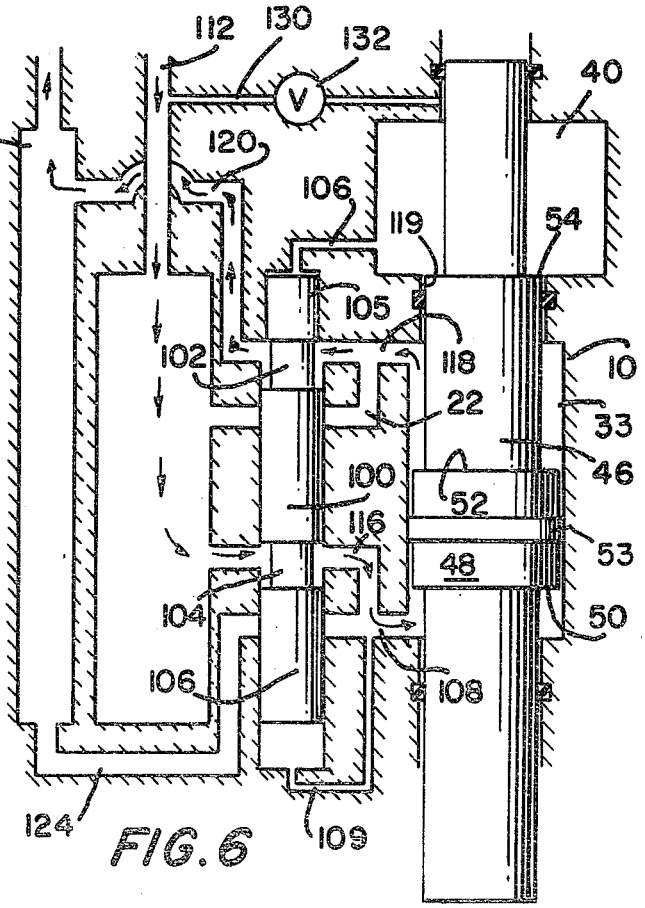
FIG. 6 is a schematic representation of still another preferred embodiment of our invention using a pressure operated valve transversely spaced from the piston and showing the valve and piston in their first positions.
Figure 6:
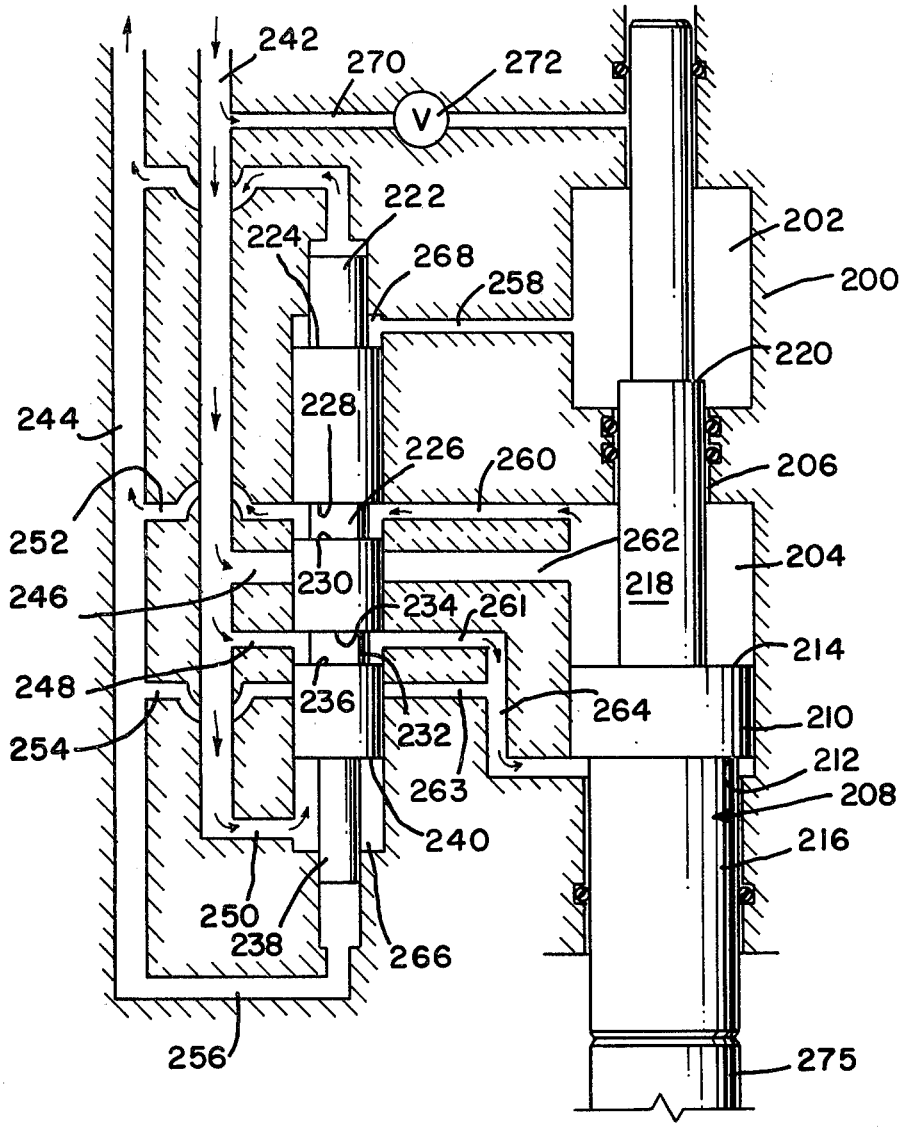

FIG. 6 and FIG. 7 are schematic representations of still another preferred embodiment of our invention using a pressure-operated valve transversely spaced from the piston. Referring specifically to FIG. 6, the housing 200 has a pressurized cushion chamber 202 separated from the separate piston chamber 204. A bore 206 having less diameter than the diameter of either the pressurized cushion chamber 202 or the piston chamber 204 interconnects the two chambers.

Piston 208 is mounted in the housing 200 and extends through the piston chamber 204, the interconnecting bore 206 and into and through the pressure cushion chamber 202. The piston is adapted to strike the anvil 275 at the bottom of its impact stroke.

The piston 208 is provided with an enlarged area 210 which has a diameter substantially the same as the diameter of the piston chamber 204. The enlarged diameter section 210 provides a downwardly extending shoulder 212 serving as a first liquid pressure surface and an upwardly extending shoulder 214 serving as a second liquid pressure surface. The diameter of the longitudinally extending portion 216 of piston 208 is greater than the diameter of longitudinally extending portion 218 of the piston 208 thereby making the area of shoulder 214 larger than the area of shoulder 212.

Piston 208 also has a cushion liquid pressure surface 220 which moves within the cushion pressure chamber 202. Portion 218 of piston 208 has a diameter substantially the same as the diameter of the interconnecting bore 206 and the length of portion 218 is sufficiently long to keep the cushion chamber 202 substantially pressure isolated from the piston chamber 204 during the entire cycle of the piston.

A valve is transversely spaced from the piston 208. The valve includes a top portion 222 of reduced diameter thus providing upwardly facing shoulder 224, a second portion 226 of reduced diameter thus providing downwardly facing shoulder 228 and upwardly facing shoulder 230, a third section of reduced diameter 232 thus providing downwardly facing shoulder 234 and upwardly facing shoulder 236, and a lower portion 238 of reduced diameter thus providing downwardly facing shoulder 240. Reduced diameter portions 222, 226 and 232 are substantially the same in diameter. Reduced diameter portion 238 has a smaller diameter than portions 222, 226 and 232. Therefore, downwardly facing shoulder 240 is larger than the shoulders 224, 228, 230, 234, and 236.

Hydraulic fluid is supplied to the system by fluid line 242. The fluid is removed from the system by means of fluid exhaust 244.

Hydraulic fluid inlets 246 and 248 extend from the fluid inlet 242 into the valve chamber. A valve drive inlet 250 also extends from the fluid inlet 242 into the lower portion of the valve chamber.

Fluid exhaust lines 252, 254, and 256 extend from the valve chamber to the exhaust line 244. The valve is provided between the various inlets and outlets of the operating and exhaust lines and a fluid line 258 to the cushion chamber 202, and fluid line outlet 260 from the piston chamber 204, a fluid line inlet 262 to the piston chamber 204 and a dual inlet-outlet line 264.

The shoulder 240 of the valve is exposed to the fluid in chamber 266 which communicates with the fluid line 242 through the inlet 250, and the shoulder 224 is exposed to the fluid in chamber 268 which communicates with the cushion chamber 202 through the line 258.

The piston 208 is shown in FIG. 6 at its impact position and the valve in its uppermost position which is referred to as its first position. The valve is forced to this position by the action of the fluid line 242 operating pressure through the valve drive inlet 250 acting on the shoulder 240 in opposition to the cushion chamber pressure on shoulder 224. With the valve in the first position the fluid pressure is supplied from fluid inlet line 242 through the inlet 248 and the dual inlet-outlet line 264. The pressure in the cushion chamber 202 is comparatively low and the force which is exerted on the shoulder area 212 of the piston is sufficient to move the piston from the first position to its uppermost or second position (see FIG. 7). As the piston travels upwardly it compresses the fluid in the cushion chamber 202 which in turn causes an increase in force to be exerted on the shoulder 224 of the valve. The cushion liquid pressure surface 220 is larger than the surface of shoulder 224 to make certain the valve moves downwardly. The valve is this forced from its first position shown in FIG. 6 to its lowermost or second position shown in FIG. 7.

With the valve in the second position shown in FIG. 7, the fluid line 242 is placed in communication with the piston chamber 204 through the inlet 246 and the inlet line 262. The fluid acts on the comparatively large shoulder 214 and the piston is driven downward with a high kinetic energy to deliver a high impact blow. During the impact stroke the shoulder 212 forces fluid from the lower portion of piston chamber 204 to the exhaust line 244. As the piston moves toward impact, the pressure of the fluid in the cushion chamber 202 decreases to the point that the opposing force resulting from the operating pressure in fluid line 242 acting on shoulder 240 is more than the force on shoulder 224 of the valve with the result that the valve moves upwardly under the action of the operation pressure on the shoulder 240 in the chamber 266.

It is an important feature of this invention that none of the lines or ports 260, 262 and 264 are ever closed by the piston during any part of the entire cycle of the piston. By proper construction, the flow switching can be made to occur near the instant of impact to ready the hammer for the return stroke. The downward stroke of the piston is limited by the position of anvil 275 so that port 264 is not closed. FIG. 6 is a schematic view. Actually the piston has a seal like the annular seal 53 shown in FIG. 2 and FIG. 3 wherein on each side of the seal the piston has a reduced diameter so the ports 260 and 262 are never closed.

The invention has the feature requiring a very low energy return stroke, the amount of energy being controlled by relative areas of the shoulder 220 and the return shoulder area 212 and the pressure in the cushion chamber 202.

The pressure range of the cushion 202 may be adjusted by flowing fluid from the fluid supply 242 through line 270 into the cushion 202 under control of control valve 272. In the embodiment of FIG. 6 and FIG. 7 pressures operate against surfaces of the control valve in opposite to the cushion pressure on the control valve. As the piston moves upwardly, the cushion pressure continually increases. At some cushion pressure with respect to the opposing pressures, the control valve begins to move to the other position.

As the piston makes the downward impact stroke, the cushion pressure decreases. At a certain pressure of the cushion pressure with respect to the opposing pressures the control valve will begin movement back to its first position.

The embodiment shown in FIG. 8 and FIG. 9 shows a compound cushion chamber 300 and a cylinder 302 which may be substituted for the cushion chambers shown in the other embodiments. With this form of the invention, the piston 304 is formed with a plunger 306 which is shaped to fit into the cylinder 302 with a slight clearance gap between their respective surfaces. The difference between the surface areas of the shoulder 308 and the shoulder 310 of the plunger 306 corresponds to the area of the pressure surface 220 as shown in the embodiment of FIG. 6 and FIG. 7.

The arrangement shown in FIG. 8 and FIG. 9 offer the ability to absorb kinetic energy from the piston when the steel of the piston is not in position to receive an impact blow, for when the piston travels so far downwardly that the plunger 306 is forced into the cylinder 302 the larger forces which are required to force the liquid out of the cylinder 302 through the clearance gap rapidly absorb kinetic energy of the piston. In other respects, the operation of the hydraulic actuator which includes the compound chamber 300 and cylinder 302 is identical to that described in connection with the other embodiments.

We claim:

1. A hydraulic actuator comprising: a liquid source for supplying an operating pressure to a housing, the housing having a pressurized cushion chamber and a separate piston chamber, said housing having a bore interconnecting the cushion chamber and the piston chamber the bore having a smaller diameter than the diameter of the cushion chamber and a smaller diameter than the diameter of the piston chamber; a piston mounted within said housing, said piston extending through the piston chamber through the interconnecting bore and into the pressurized cushion chamber, said piston having a first liquid pressure surface in the piston chamber and a second liquid pressure surface in the piston chamber and a portion thereof having a diameter substantially the same as the diameter of the interconnecting bore and long enough to keep the cushion chamber substantially pressure isolated from the piston chamber during the entire cycle, said piston also having a cushion chamber liquid pressure surface which alternately, continuously compresses the liquid in the cushion chamber during movement of the piston in one direction and continuously permits the liquid in the cushion chamber to expand during movement of the piston in the other direction as the piston reciprocates; and piston reciprocating means comprising valve means, a first port and a second port axially spaced from the first port, the ports supplying operating pressure from the valve means to the piston chamber, the spacing between the ports being such that the ports are continuously open during the entire cycle of the piston, the piston reciprocating means further comprising hydraulic flow conduits connected between the liquid source and said valve means, said valve means being biased in a first direction by having a first portion thereof continuously directly subjected to the cushion chamber pressure, said valve means and said hydraulic flow conduits being constructed so that during the entire cycle the operating pressure acts in a direction opposite said first direction on a second portion of the valve means to oppose the bias resulting from the pressure on the valve means first portion, the operating and cushion pressures and the dimensions of the piston cushion chamber liquid pressure surface and valve means first and second portions being chosen such that said valve means begins moving to a first piston when the pressure in the cushion chamber relative to said operating pressure reaches a first predetermined level to permit the application of operating pressure to said first liquid pressure surface, said valve means beginning to move a second position when the pressure in the cushion chamber reaches a second predetermined level relative to said operating pressure to permit the application of operating pressure to said second piston liquid pressure surface.

2. A hydraulic actuator in accordance with claim 1 wherein the valve means includes a valve member transversely spaced from said piston and the hydraulic flow conduits include a fluid pressure line extending from the cushion chamber to the valve member, said valve member being constructed to permit in a first position thereof the flow of hydraulic fluid through said first port and against said first liquid pressure surface to move said piston upwardly after the pressure of the cushion chamber relative to said operating pressure reaches said first predetermined level, said valve member beginning to move to a second position when the cushion chamber pressure exceeds said second predetermined level relative to said operating pressure due to upward movement of the piston, to exhaust fluid from the piston chamber through said first port and permit the flow of hydraulic fluid through said second port and against the second liquid pressure surface.

3. A hydraulic actuator in accordance with claim 1 wherein the pressurized cushion chamber further includes a kinetic energy absorption cylinder and the piston has a plunger portion shaped to fit into the kinetic energy absorption cylinder with a slight clearance gap when the piston travels so far in the direction toward the kinetic energy absorption cylinder that the plunger portion moves into said cylinder.

4. A hydraulic actuator in accordance with claim 1 wherein said first liquid pressure surface of the piston is a downwardly extending shoulder; and said second liquid pressure surface of the piston is an upwardly extending shoulder of larger area than the first liquid pressure surface of the piston.

* * * * *

UNITED STATES PATENT AND TRADEMARK OFFICE

CERTIFICATE OF CORRECTION

PATENT NO. : 4,142,447

DATED : March 6, 1979

INVENTOR(S) : Eugene L. Krasnoff et al

It is certified that error appears in the above-identified patent and that said Letters Patent are hereby corrected as shown below:

Column 8, line 10, "piston" should read -- position --.

Column 8, line 14, before "a" insert -- to --.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*